US007191729B2

(12) United States Patent
DeGroat, Jr.

(10) Patent No.: US 7,191,729 B2
(45) Date of Patent: Mar. 20, 2007

(54) FLARE CARRIER AND SUPPORT

(76) Inventor: Carl DeGroat, Jr., 5954 Sayles Corner Rd., Moravia, NY (US) 13118

( * ) Notice: Subject to any disclaimer, the term of this patent is extended or adjusted under 35 U.S.C. 154(b) by 261 days.

(21) Appl. No.: 11/011,843

(22) Filed: Dec. 14, 2004

(65) Prior Publication Data

US 2006/0137561 A1 Jun. 29, 2006

(51) Int. Cl.
*E01F 9/012* (2006.01)
*E01F 9/019* (2006.01)

(52) U.S. Cl. ..... 116/63 P; 116/DIG. 40

(58) Field of Classification Search ..... 116/63 P, 116/63 R, 28 R, DIG. 40; 248/518, 519, 248/520, 528, 529; 102/343; 40/606.03, 40/610, 612
See application file for complete search history.

(56) References Cited

U.S. PATENT DOCUMENTS

| | | | | | |
|---|---|---|---|---|---|
| 2,070,882 | A | | 2/1937 | Brown | 248/520 |
| 2,220,407 | A | | 11/1940 | Joss | 246/488 |
| 2,517,119 | A | * | 8/1950 | Le Due | 340/473 |
| 2,557,859 | A | * | 6/1951 | Bernstein | 116/173 |
| 2,781,017 | A | * | 2/1957 | Fuller et al. | 116/63 R |
| 2,844,897 | A | * | 7/1958 | Vance, Jr. | 40/610 |
| 2,902,239 | A | * | 9/1959 | Janecka, Jr. | 248/464 |
| 3,051,422 | A | * | 8/1962 | Crump et al. | 248/518 |
| 3,146,613 | A | | 9/1964 | Hiner | 102/343 |
| 3,380,429 | A | * | 4/1968 | Moinicken et al. | 116/63 R |
| 3,485,469 | A | * | 12/1969 | Batcheller | 248/126 |
| 3,591,116 | A | * | 7/1971 | Dalum | 248/172 |
| 3,611,934 | A | | 10/1971 | Schaefer | 102/343 |
| 3,734,595 | A | * | 5/1973 | Bendzick | 359/553 |
| 3,847,335 | A | * | 11/1974 | Ross | 248/166 |
| 3,905,324 | A | | 9/1975 | English | 116/63 P |
| 3,922,998 | A | * | 12/1975 | May | 116/40 |
| 4,108,311 | A | * | 8/1978 | McClendon | 206/573 |
| 4,777,751 | A | * | 10/1988 | Pasquale | 40/612 |
| 4,817,318 | A | * | 4/1989 | Strauch | 40/610 |
| 5,012,923 | A | * | 5/1991 | Hayes | 206/443 |
| 5,094,422 | A | * | 3/1992 | Tiffany | 248/519 |
| 5,124,857 | A | * | 6/1992 | Pitz | 359/872 |
| 6,394,522 | B1 | | 5/2002 | Ingoldt | 294/143 |
| 6,527,245 | B2 | | 3/2003 | Graves et al. | 248/518 |
| 2006/0137561 | A1 | * | 6/2006 | DeGroat, Jr. | 102/343 |

* cited by examiner

*Primary Examiner*—R. Alexander Smith
(74) *Attorney, Agent, or Firm*—Sandra M. Kotin

(57) ABSTRACT

A storage container for flares in combination with an extendable support structure to elevate the burning flares above the road bed. The storage container and the support structure are mounted on a heavy base. The extendable support structure has flare holders at the top to securely hold the burning flares and pivoted connections so the structure can be folded down for transport. Plungers cooperate with the flare holders to eject any residue so the spent flare can easily and quickly be replaced without having to wait for cooling or to tip the device over to accomplish the removal of the residue. Locking means retains the structure in the extended orientation. A carrying handle affixed to the front of the storage container enables easy transport and gaskets on the inside of the cover of the storage container prevent moisture from entering and rendering the flares ineffective. The storage container can hold multiple flares. The entire device is fireproof and of sufficient weight to prevent its being upset during use. Reflective tape on the support structure increases the visibility of the device.

21 Claims, 5 Drawing Sheets

FLARE CARRIER AND SUPPORT

FIELD OF THE INVENTION

The instant invention relates to a fire-proof system for transporting highway flares and supporting burning flares.

BACKGROUND OF THE INVENTION

It is desirous for all drivers to carry safety equipment such as jumper cables and highway flares with them in their cars. Driver's kits are available that contain basic first aide materials and one or two flares. Such kits are usually contained in a box, often made of plastic or cardboard. A driver may have such a kit for a considerable time before it is needed. After a time the flares may become damp and ineffectual. Law enforcement officers and firefighters must carry a supply of flares at all times and must be able to set them up at the sight of a highway accident quickly and safely. The flares must ignite readily and new ones must be repeatedly set out, sometimes over considerable time periods. The flares are usually set directly on the ground, but ideally they should be elevated above the roadbed for a wider range of visibility.

In U.S. Pat. No. 2,070,882 Brown teaches a foldable support for flares. Two metal strips, each with a right angle or L-shaped bend at one end are connected near their midpoints by means of a hollow rivet or grommet. The two strips may be superimposed one over the other for storage and can fit into a case holding two flares. In use, the strips are opened to form an "X" which is elevated by the short leg of the L. A flare can be supported in the X by placing the spike affixed to the bottom of the flare into the hollow rivet. The flare may be ignited and can burn completely while being supported in a slightly slanted orientation permitting any dripping material or ash to run down the side. This support system maintains the lighted flare upright, but does not elevate the flare above the roadbed. Visibility of the flare from a distance or over a hill is very limited. Each support is usable for only one flare at a time. Residue must be removed by inverting the support.

English devised a support that can hold four flares at a time. A truncated pyramidal support is mounted on a flat base having a foldable handle on one corner. A hole in each surface of the support accepts the spike affixed to the bottom of the flare. The base has weight so the support is not easily tipped over and the handle enables the support to be carried even with four ignited flares in place. The flares are maintained at road level. (U.S. Pat. No. 3,905,324) This device can only be used with spiked flares and must be inverted to remove the residual material before the next flares can be inserted.

Graves, in U.S. Pat. No. 6,527,245, describes a flare holder that attaches to a traffic cone or other upright structure to elevate the burning flare some distance above road level. The holder is shaped to hug the cone and a pivoted shield swings down to catch the ashes so they do not come in contact with the cone. The flare is inserted into the top of the holder and is held in place by means of a hinge pin. This holder cannot be used if there is no traffic cone or other such support at the site. One flare can be inserted at a time and the holder must be removed from the cone and inverted to remove the residual material. Even with the shield, there is the possibility that burning material can fall onto the cone, especially under windy conditions.

Joss developed a container for flares that also provides the means to support one burning flare. (U.S. Pat. No. 2,220, 407) This container is small and designed for signal flares such as those used by ships and airlines and can be placed into a pocket in a life preserver. The container is a waterproof case with felt lining shaped to hold four separated flares. A strip holder for a burning flare is pivotally attached to one end of the exterior of the container and can be swung outward when needed. The container resting on its other end acts as the support for the burning flare. A hole in the outer end of the strip holder holds the flare in an upright orientation. A flange near the end of the flare prevents it from slipping through the hole. There is also a cap to ignite the flares. The remnants of the burned flare must be removed by hand before the next one can be inserted. This design would not be practical for the considerably larger highway flares.

A container for highway flares is taught by Hiner in U.S. Pat. No. 3,146,613. A box holds four flares arranged in alternating array. Each flare is held at its lower end in a socket that is mounted and controlled by a biasing spring. The mountings are attached to the inside of the box. The top end of each flare is maintained by a holder that is pivoted on a tie rod connected to a compression spring. When a latch holding the first flare is released the flare is ignited by a striking member and moves to a vertical position. When each successive flare burns down the burning residue ignites the next flare which is released and moves to the vertical position. To stop the sequence, the burning residue can be extinguished. One flare burns at a time. The flares are at road level unless the box is raised by some external support. Once the four flares are spent, the box must be reloaded. There is no auxiliary storage apart from the four contained flares.

Devices have also been developed to carry a number of flares so they can be quickly ignited and placed directly on the ground without any support means. These devices are open carriers that have strikers to ignite a flare and a holder for the burning flare which is then used to ignite subsequent flares for placement along the road bed. (Schaefer, U.S. Pat. No. 3,611,934 and Ingoldt, U.S. Pat. No. 6,394,522) These devices are for use by fire fighters and law enforcement personnel and are not meant to store flares. They must be loaded f or each use from another storage source. The burning flares are placed directly on the ground, usually substantially horizontal.

None of the prior art patents provide for storage of several flares and means to support the burning flares at a distance above the ground level. There is a need for a storage container in combination with a support system so that flares are easily accessed and the lighted flares can be elevated so the light can be seen from considerable distance and when oncoming traffic comes over a hill. There is a need for a flare support from which the hot residue can be removed without having to invert the support system. There is a need for a support system that cannot be tipped over, that does not require any outside means or equipment to elevate the burning flare, and that is fireproof.

BRIEF SUMMARY OF THE INVENTION

The present invention provides a fireproof system having a weighted base with an attached storage container capable of holding multiple flares. Also attached to the base is an extendable support means that can be raised as needed to support more than one burning flare and that enables easy replacement of the spent flares and hot residue.

It is an object of the present invention to provide a fireproof storage container to hold multiple flares.

Another object of the present invention is to provide a support system for more than one burning flare.

A further object of the present invention is to provide an expandable support so the burning flares can be raised above the road bed for wide visiblitiy A still further object of the present invention is to provide a support for burning flares from which hot reside can be removed with no danger of burns to the user and so another flare can be quickly inserted.

Another object of the present invention is to provide a support system that can be folded down for ease of transport.

An object of the present invention is to provide a support and supply system for flares that is easy to manufacture.

A further object of the present invention is to provide a support and supply system for flares that can be kept in the trunk of a car or other storage area in a vehicle with the flares remaining dry and the system being easy to set up and use.

The invention is a device for storing multiple highway flares and for supporting and elevating the flares during burning. The device comprises a substantially flat base having four sides, an anterior end and a posterior end. The base is for placement on an outdoor surface. There is a storage container for storing the flares which has a bottom, a front wall, a rear wall, two side walls and a cover, the bottom being integral with the base adjacent the anterior end. A support assembly for supporting the burning flares and elevating the flares substantially above the outdoor surface comprises at least two struts, an at least one first strut and an at least one second strut, each having an upper end, a lower end and a midpoint. The at least two struts are pivoted together at their midpoints and have pivot means at their lower ends. Anchor means integral with the base adjacent the posterior end pivotally receive the pivot means of the at least one first strut and pivotally and slidably receive the pivot means of the at least one second strut so that the at least two struts can be folded down against the base and can be raised to an elevated orientation without detachment from the base. There is at least one reversible locking means within the anchor means for locking the at least one second strut into the elevated orientation. Holder means affixed to the upper ends of the at least two struts securely hold the flares during burning. When flares are needed the device is placed on the outdoor surface, the at least two struts are pivotally raised to the elevated orientation, the at least one second strut is locked in position, the cover of the storage container is opened, two flares are removed and placed into the holder means and ignited.

Also disclosed is a device for storing multiple highway flares and for supporting and elevating the flares during burning. The device comprises a substantially flat base having four sides and an anterior end and a posterior end. The base is for placement on an outdoor surface. There is a storage container for storing the flares which has a bottom, a front wall, a rear wall, two side walls and a cover, the bottom being integral with the base adjacent the anterior end. A support assembly for supporting the burning flares and elevating the flares substantially above the outdoor surface comprises four struts, a first and a second lower strut and a first and a second upper strut, each having an upper end, a lower end and a midpoint. The two lower struts are pivoted together at their midpoints and the two upper struts are pivoted together at their midpoints. The first upper strut is pivotally attached at its lower end to the upper end of the first lower strut and the second upper strut is pivotally attached at its lower end to the upper end of the second lower strut in such a manner that the four struts can function together when being folded downward and when being extended to an elevated orientation. The two lower struts having pivot means at their lower ends. There are anchor means integral with the base adjacent the posterior end for pivotally receiving the pivot means of the first lower strut and for pivotally and slidably receiving the pivot means of the second lower strut so that the four struts can be folded downward to rest against the base and can thereafter be extended to the elevated orientation without detachment from the base. There is at least one reversible locking means within the anchor means for locking the second lower strut into place when the four struts are extended to the elevated orientation. Holder means are affixed to the upper ends of the two upper struts for securely holding the flares during burning. When flares are needed the device is placed on the outdoor surface, the four struts are pivotally extended to the elevated orientation and locked therein, the cover of the storage container is opened, and two flares are removed and placed into the holder means and ignited.

A device for storing multiple highway flares and for supporting and elevating the flares during burning comprises a substantially flat base having an anterior end and a posterior end the base for placement on an outdoor surface, and a storage container for storing the flares. The storage container has a bottom, a front wall, a rear wall, two side walls and a cover and the bottom is integral with the base adjacent the anterior end. There is a support assembly for supporting the burning flares and elevating the flares substantially above the outdoor surface. The support assembly comprises foldable support means and anchor means integral with the base adjacent the posterior end. The anchor means pivotally and slidably contains the foldable support means. There is at least one reversible locking means within the anchor means for locking the foldable support means into an elevated orientation. Holder means affixed to the foldable support means securely holds the flares during burning. When flares are needed the device is placed on the outdoor surface, the foldable support means extended to the elevated orientation and locked therein, the cover of the storage container is opened, two flares are removed and placed into the holder means and ignited.

Other features and advantages of the invention will be seen from the following description and drawings.

BRIEF DESCRIPTION OF THE DRAWINGS

FIG. 7-B is a front perspective view of the lower locking strut in the partially elevated position;

FIG. 7-C is a front perspective view of the lower locking strut in the fully extended and locked position;

FIG. 8-B is a rear plan view of the support assembly in the fully extended position.

DETAILED DESCRIPTION OF THE INVENTION

Figure 1:
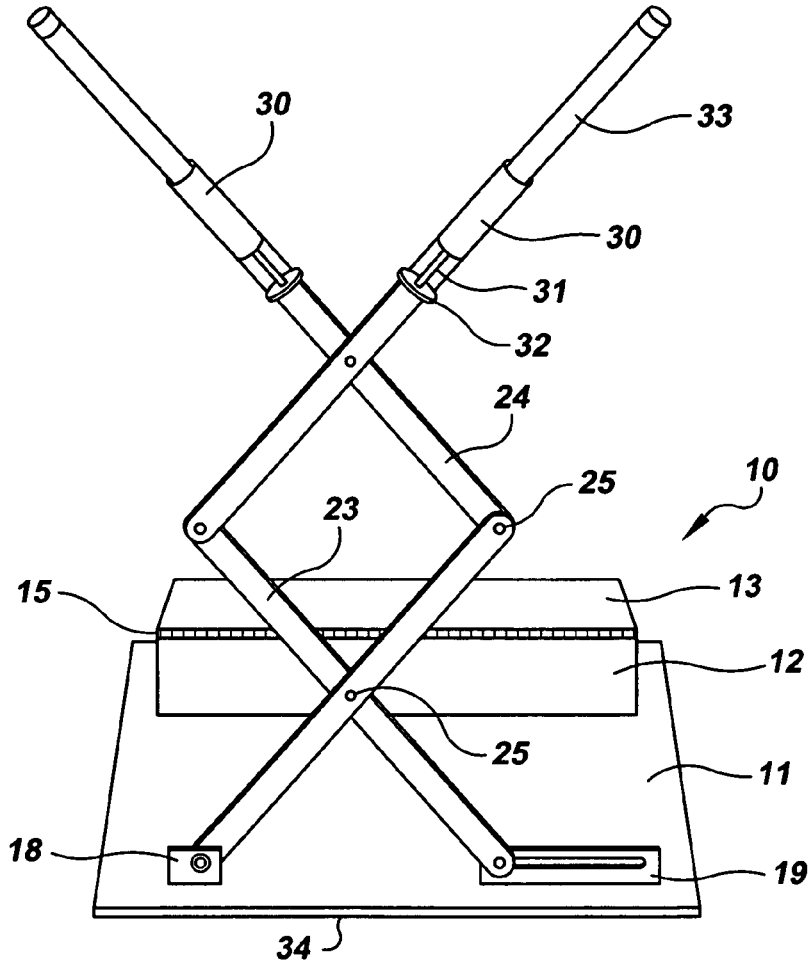
FIG. 1 is a rear perspective view of the carrier and support with the flare supports extended and with flares in the holders.
Figure 3:
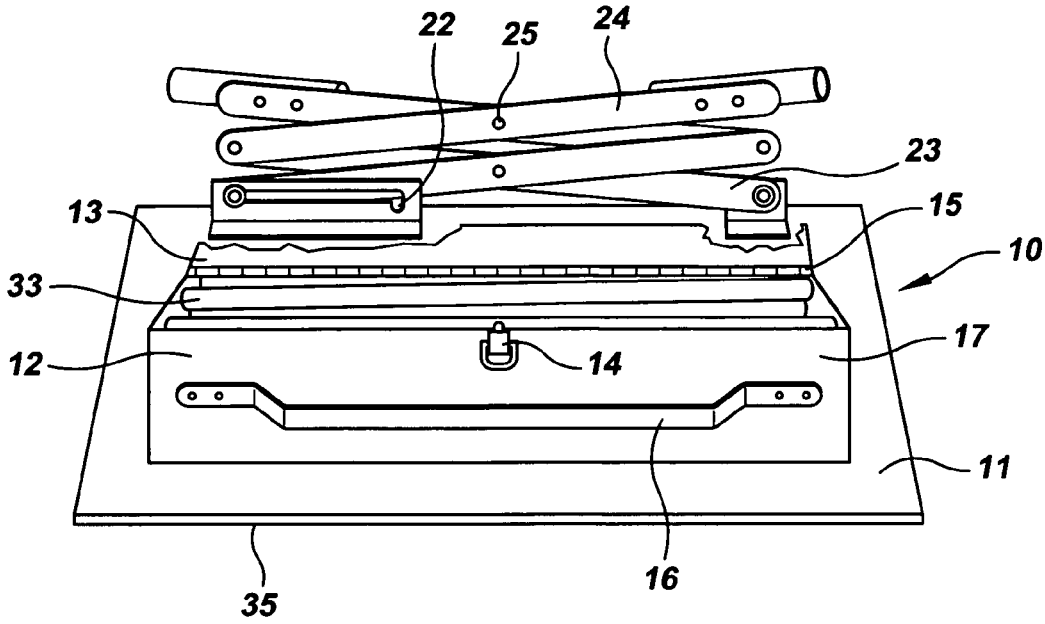
FIG. 3 is a front perspective view of the carrier and support with the supports folded and the cover open to reveal a supply of flares.
Figure 4:
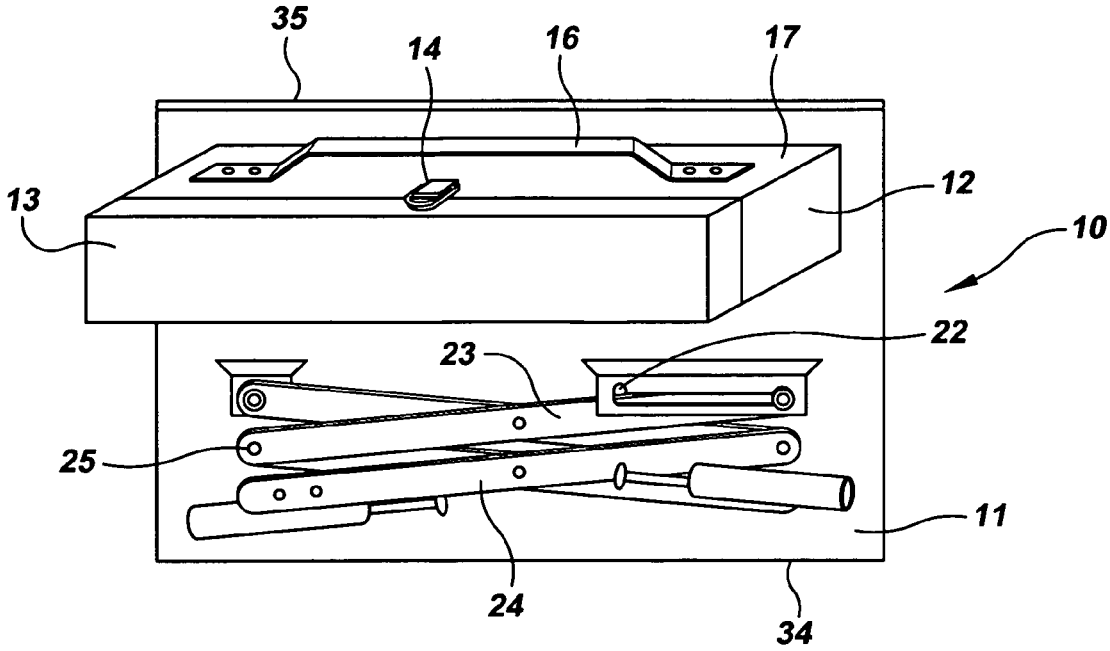
FIG. 4 is a top perspective view of the carrier and support with the supports folded and ready for transport.

The flare carrier and support or Flare Mate 10 can be seen in FIG. 1 with two flares 33 in place ready to be ignited. The Flare Mate 10 may have a rectangular base 11 on which may be permanently affixed a storage box 12 containing multiple flares of a type usually ignited and set up along a highway to signal oncoming traffic of an accident or other highway problem. The storage box 12 may be mounted near the anterior end 35 of the base 11. There may be a well fitting cover 13 that may be attached to the storage box 11 by means of a hinge 15 that enables the cover 13 to be easily opened and closed. The hinge 15 may permit the cover to be fully opened and to rest back on the base 11 for unhindered access to the flares 33 and so a user does not have to hold the cover 13 opened. See FIG. 3. A latch 14 may maintain closure of the storage box 11 during storage and transport. One part of the latch 14 may be affixed to the front panel 17 of the storage box 12 and the cooperating part may be affixed to the front apron of the cover 13. Other closure means known in the art may be utilized. There may also be a carrying handle 16 affixed to the front panel 17 of the storage box 12. Mounting the handle 16 on the front panel 17 may make it easy to transport the Flare Mate 10 in a balanced manner by carrying it much like a brief case with the anterior end 35 facing upward as seen in FIG. 4.

Figure 7A:
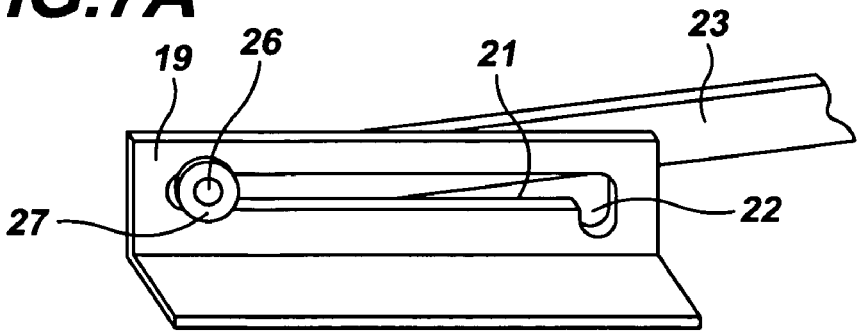
FIG. 7-A is a front perspective view of the lower locking strut in the folded position.
Figure 7B:
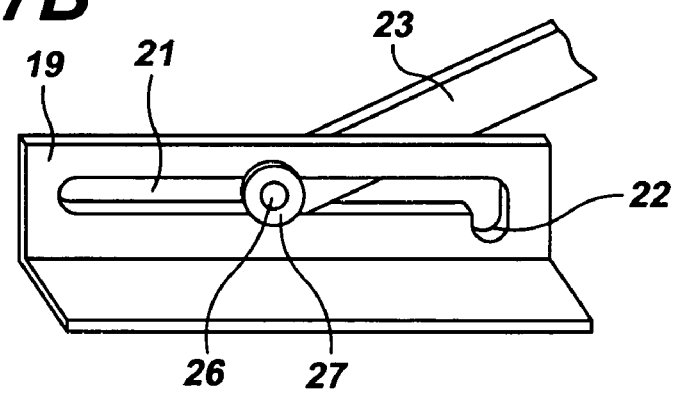
Figure 7C:
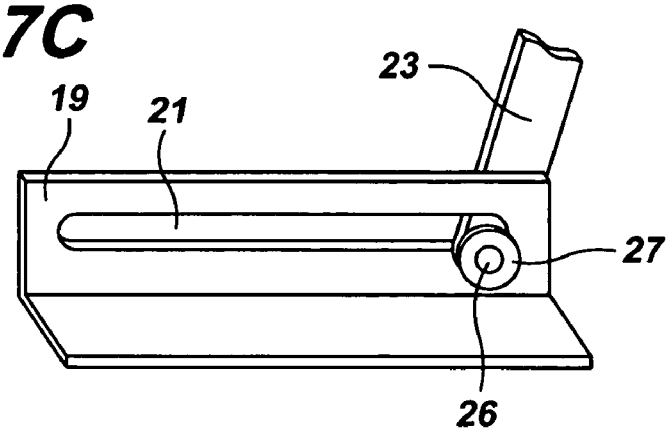

A support assembly 20 may be attached to the base 11 by means of two support anchors, a fixing support anchor 18 having a substantially round opening (not shown) and a sliding support anchor 19 having a horizontal slotted opening 21. There may be a stop notch 22 in the inside end of the slotted opening 21. The support anchors may be mounted transversely near the posterior end 34 of the base 11. Pivotally engaged in each support anchor may be a first end of a lower strut 23. Each lower strut 23 may be so engaged into the opening in its respective support anchor with a bolt 26 and two washers 27, one on each side of the support anchor. The bolt 26 of the lower strut 23 mounted in the fixed support anchor 18 may only move pivotally while the bolt 26 of the lower strut 23 mounted in the sliding support anchor 19 may move pivotally and transversely across the slotted opening 21. When it is necessary to elevate the flares the bolt 26 may be lowered into the stop notch 22 to fix or lock this lower strut 23 into the elevated position. (FIGS. 7-A, 7-B and 7-C)

Figure 2:
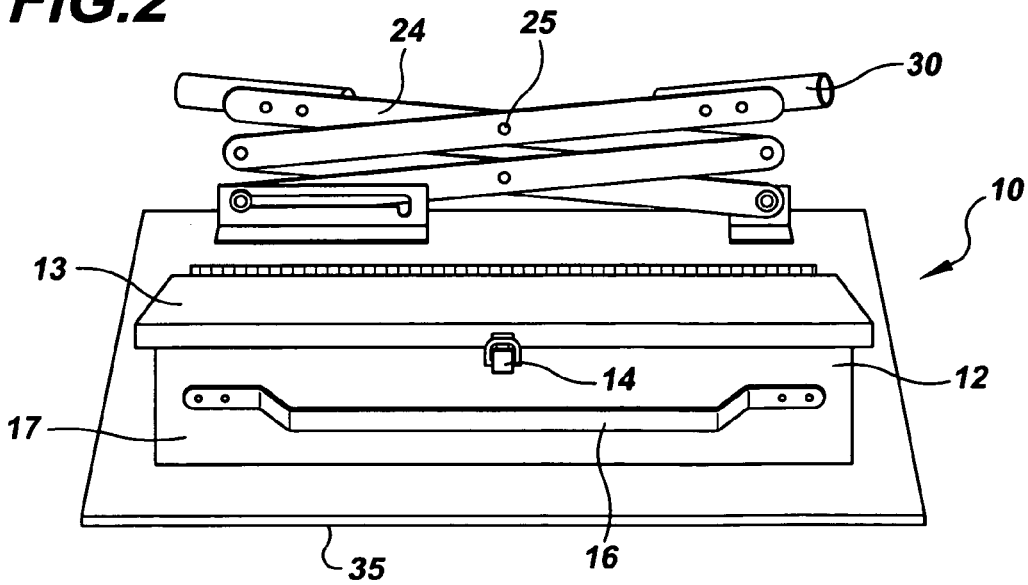
FIG. 2 is front perspective view of the carrier and support with the flare supports folded down.
Figure 8A:
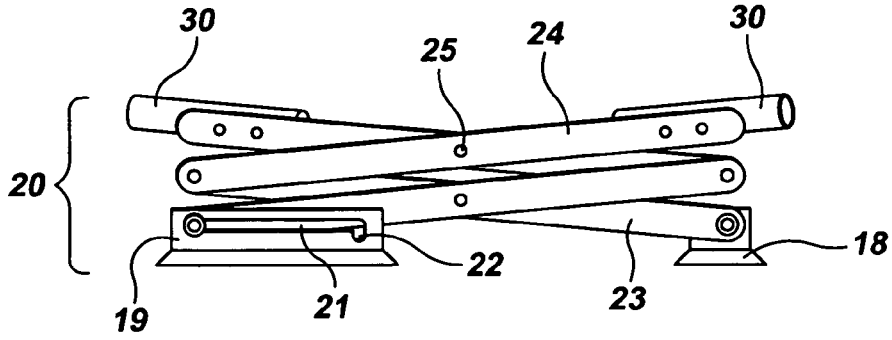
FIG. 8-A is a front plan view of the support assembly in the folded position.
Figure 8B:
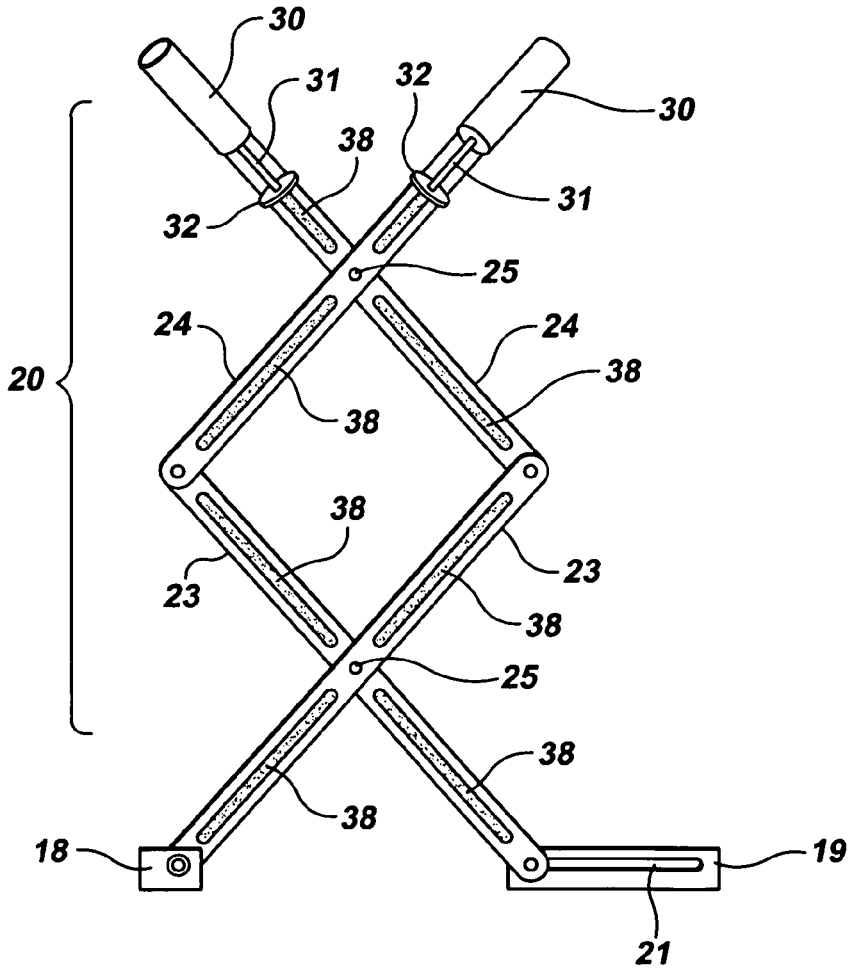

The two lower struts 23 may be pivotally joined together at their centers by means of a grommet 25 or other pivotal joining means known in the art. There may be two upper struts 24 pivotally attached at a first end to the second end of each lower strut 23 by means of a grommet 25 and the two upper struts 24 may also be pivotally joined together at their midpoints with a grommet 25. The four pivotally joined struts may form the extendable support assembly 20 that may elevate the flares 33 so as to provide better visibility of the burning flares from a distance or on hilly terrain. The support structure 20 may be folded down against the base 11 for transport and storage as seen in FIGS. 2 and 8-A. FIG. 8-B may show the struts in their fully extended and locked position.

Attached to the second end of each upper strut 24 may be a cylindrical flare holder 30 equipped with a plunger 31 having a plunger stop 32 at its distal end. The flare holders 30 may be sized to accept the standard flares known in the art. (FIG. 1) When the flares 33 are spent and ready for replacing the user need only move the plunger upward to eject the remaining portion of the flare and insert a new one. There may be no need to touch the burning residue or handle it in any way. The entire system does not have to be moved, tilted or inverted to remove the residue before inserting the next flare. The plunger 31 may be long enough to push the residue completely out of the flare holder 30.

Figure 5:
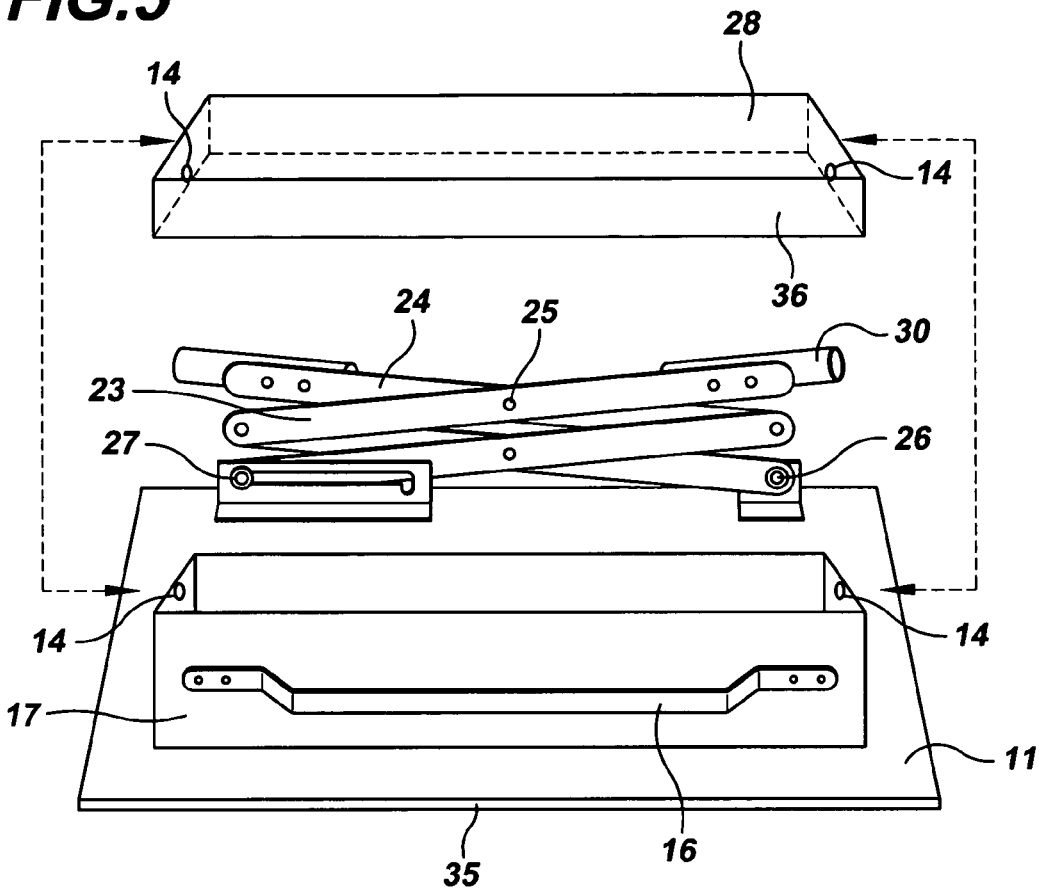
FIG. 5 is a front perspective view of the carrier and support with the supports folded and an alternative cover raised.
Figure 6:
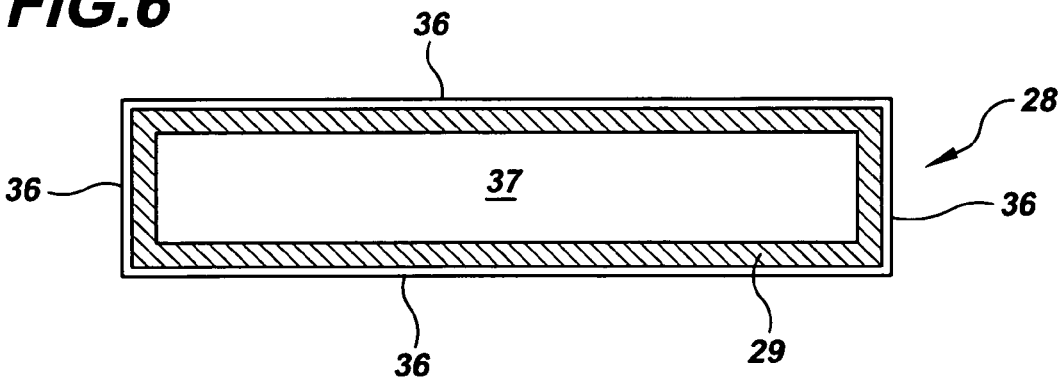
FIG. 6 is a bottom plan view of the alternate cover.

The hinge 15 connecting the top 13 to the storage box 12, as described above, permits easy access to the flares 33 stored in the storage box 12, but may not provide a water proof seal along the back edge. An alternative cover 28 with an apron 36 extending around all four sides may prevent water from seeping into the storage box 12. See FIG. 5. There may be latches 14 on opposing sides of the storage box 12 with cooperating members on opposing sides of the cover 28 to retain the cover 28 when not in use. To provide a good seal against the entry of water there may be a rubber gasket 29 or other sealing means around the periphery of the underside 37 of the cover 28 as seen in FIG. 6.

The storage box 12 may be loaded with flares and stored in the trunk or other storage area in a vehicle. When needed the Flare Mate 10 may be carried by the handle 16 and set down at any site where burning flares are needed. The weight and sturdy construction of the Flare Mate 10 may insure stability even if the ground on which it is placed is not flat or smooth. The storage box 12 may be opened easily and in dry weather the cover may be left open. In inclement weather the cover may be closed to protect the remaining flares. To set up the support system, the struts may be raised to the elevated orientation and locked in place by securing the pivot bolt 26 of one lower strut 23 into the stop notch 22 of the sliding support anchor 19 all in one quick motion. Two flares may be placed into the flare holders 30 and ignited. As each flare is spent the residue may be removed by raising the plunger 31. Any remaining material may be completely expelled. New flares may be inserted and ignited immediately.

The Flare Mate 10 may be designed primarily for use by law enforcement authorities, fire companies, school buses, fleet trucks and other commercial transporters. Therefore, the flare Mate 10 must be sturdy and heavy enough for frequent use and so that it cannot be tipped over or dislodged either by a person working nearby or by heavy winds. It may also be necessary that burning flares be continually supported over considerable time periods. For this reason the base 11 and storage box 12 may be constructed of 0.25 in (0.64 cm) aluminum diamond plate. The struts 23 and 24 may also be constructed of 0.25 in (0.64 cm) aluminum strips. Since the burning flares 33 are supported by the support assembly 20 affixed to the base 11 it may be essential that all parts of the Flare Mate 10 be fire proof. Other rigid and fire-proof materials may also be used as long as the weight is sufficient to support the burning flares with no chance of tipping and the storage box is water proof, as noted above. The storage box 11 and support assembly 20 may be affixed to the base by welding or other means known in the art. The handle 16 may be attached to the storage box 11 by welding, rivets or other known methods.

Typically, the base 11 may be 12 in. (30.5 cm) deep and 18 in (45.7 cm) wide. The exterior dimensions of the storage box 12 may be 16.5 in (41.9 cm) long by 4 in (10.2 cm) wide and 3.5 in (8.9 cm) high. The handle span may be 13.5 in (34.3 cm) with a hand hold of 6 in (15.2 cm) This box may hold ten 13.5 in (34.3 cm) flares. The four struts 23 and 24 may be 14 in (35.6 cm) long and 1 in (2.5 cm) wide. The fixed support anchor 18 may be 2.5 in (6.4 cm) wide and 2 in (5 cm) high and the sliding support anchor 19 may be 6 in (15.2 cm) wide and 2 in (5 cm) high with the slide opening measuring 5 in (12.7 cm) long and ⅜ in (0.95 cm) wide. The flare holders 30 may be 3 in (7.6 cm) long with a 1⅜ in (34.9 cm) exterior diameter and 1.25 in (3.2 cm) interior, diameter. The plunger 31 may be 4 in (10.2 cm) long.

These measurements are representative of one embodiment of the Flare Mate 10 and various other dimensions may be utilized according to the needs of the user such as the number of flares to be contained in the storage box and the desired extended height of the support assembly. More than one stop notch in the slide opening may permit more than one height setting.

To further increase the visibility of the warning properties of the flare Mate 10 reflective tape 38 or other reflective means may be affixed to one or both sides of each strut 23 and 24. The reflective tape 38 may be seen in FIG. 8-B.

While two embodiments of the present invention have been illustrated and described in detail, it is to be understood that this invention is not limited thereto and may be otherwise practiced within the scope of the following claims.

I claim:

1. A device for storing multiple highway flares and for supporting and elevating the flares during burning, said device comprising;

a substantially flat base having four sides, an anterior end and a posterior end, said base for placement on an outdoor surface;

a storage container for storing the flares, said storage container having a bottom, a front wall, a rear wall, two side walls and a cover, the bottom being integral with the base adjacent the anterior end;

a support assembly for supporting the burning flares and elevating said flares substantially above the outdoor surface, said support assembly comprising at least two struts, an at least one first strut and an at least one second strut, each having an upper end, a lower end and a midpoint, the at least two struts being pivoted together at their midpoints and having pivot means at their lower ends;

anchor means integral with the base adjacent the posterior end, said anchor means for pivotally receiving the pivot means of the at least one first strut and for pivotally and slidably receiving the pivot means of the at least one second strut so that the at least two struts can be folded down against the base and can be raised to an elevated orientation without detachment from the base, and at least one reversible locking means within said anchor means for locking the at least one second strut into the elevated orientation; and holder means affixed to the upper ends of the at least two struts for securely holding the flares during burning;

whereby when flares are needed the device is placed on the outdoor surface, the at least two struts are pivotally raised to the elevated orientation, the at least one second strut is locked in position, the cover of the storage container is opened, two flares are removed and placed into the holder means and ignited.

2. A device for storing multiple highway flares and for supporting and elevating the flares during burning, said device comprising;

a substantially flat base having four sides, an anterior end and a posterior end, said base for placement on an outdoor surface;

a storage container for storing the flares, said storage container having a bottom, a front wall, a rear wall, two side walls and a cover, the bottom being integral with the base adjacent the anterior end; and a support assembly for supporting the burning flares and elevating said flares substantially above the outdoor surface, said support assembly comprising four struts, a first and a second lower strut and a first and a second upper strut, each having an upper end, a lower end and a midpoint, the two lower struts being pivoted together at their midpoints and the two upper struts being pivoted together at their midpoints, the first upper strut being pivotally attached at its lower end to the upper end of the first lower strut and the second upper strut being pivotally attached at its lower end to the upper end of the second lower strut in such a manner that the four struts can function together when being folded downward and when being extended to an elevated orientation, and the two lower struts having pivot means at their lower ends;

anchor means integral with the base adjacent the posterior end, said anchor means for pivotally receiving the pivot means of the first lower strut and for pivotally and slidably receiving the pivot means of the second lower strut so that the four struts can be folded downward to rest against the base and can thereafter be extended to the elevated orientation without detachment from the base;

at least one reversible locking means within said anchor means for locking the second lower strut into place when the four struts are extended to the elevated orientation; and holder means affixed to the upper ends of the two upper struts for securely holding the flares during burning;

whereby when flares are needed the device is placed on the outdoor surface, the four struts are pivotally extended to the elevated orientation and locked therein, the cover of the storage container is opened, and two flares are removed and placed into the holder means and ignited.

3. A device as in claim 2 wherein the holder means comprises a cylinder sized to accept and securely hold an end of the flare.

4. A device as in claim 2 further comprising ejection means cooperating with the holder means for ejecting flare residue and making it possible to immediately place a new flare in the holder means.

5. A device as in claim 4 wherein the ejection means comprises a plunger cooperating with the interior of the holder means and slidably contained therein whereby when the flare has burned to the end the plunger is moved upward and ejects the remainder of the flare and is thereafter retracted so a new flare may be placed in the holder means.

6. A device as in claim 2 wherein the cover is hingedly attached to the upper edge of the rear wall of the storage container such that the cover can easily be opened and closed and whereby the cover can be opened backward to expose the flares and does not have to be held open by the user.

7. A device as in claim 2 further comprising latch means for maintaining closure of the storage container during transport and storage.

8. A device as in claim 2 wherein the cover further comprises apron means circumscribing the cover for preventing water from entering the container.

9. A device as in claim 8 wherein the cover further comprises sealing means around the periphery of the interior of the cover for preventing water from entering the storage container.

10. A device as in claim 2 further comprising handle means affixed to the exterior front wall of the storage container for ease of carrying the device.

11. A device as in claim 2 wherein the base has substantial weight so that the device cannot be upset during use.

12. A device as in claim 2 further comprising reflective means affixed to the struts for increasing visibility and enhancing warning capabilities of the device.

13. A device for storing multiple highway flares and for supporting and elevating the flares during burning, said device comprising;

a substantially flat base having an anterior end and a posterior end, said base for placement on an outdoor surface;

a storage container for storing the flares, said storage container having a bottom, a front wall, a rear wall, two side walls and a cover, the bottom being integral with the base adjacent the anterior end;

a support assembly for supporting the burning flares and elevating said flares substantially above the outdoor surface, said support assembly comprising foldable support means;

anchor means integral with the base adjacent the posterior end, said anchor means for pivotally and slidably retaining the foldable support means;

at least one reversible locking means within said anchor means for locking said foldable support means into an elevated orientation; and holder means affixed to the foldable support means for securely holding the flares during burning;

whereby when flares are needed the device is placed on the outdoor surface, the foldable support means is extended to the elevated orientation and locked therein, the cover of the storage container is opened, two flares are removed and placed into the holder means and ignited.

14. A device as in claim 13 further comprising latch means for maintaining closure of the storage container during transport and storage.

15. A device as in claim 13 further comprising ejection means cooperating with the holder means for ejecting flare residue and making it possible to immediately place a new flare in the holder means.

16. A device as in claim 15 wherein the ejection means comprises a plunger.

17. A device as in claim 13 further comprising sealing means integral with the interior of the cover to prevent water from entering the storage container when the cover is closed.

18. A device as in claim 13 further comprising handle means affixed to the exterior front wall of the storage container for ease of transport of the device.

19. A device as in claim 13 wherein the device has considerable weight so it cannot be upset during use.

20. A device as in claim 13 wherein the device is composed of fireproof material.

21. A device as in claim 13 further comprising reflective means affixed to the support means for increasing visibility and enhancing warning capabilities of the device.

* * * * *